US007632144B2

(12) United States Patent
Sakaguchi et al.

(10) Patent No.: US 7,632,144 B2
(45) Date of Patent: Dec. 15, 2009

(54) METHOD OF ATTACHING TERMINAL AND COAXIAL CABLE WITH TERMINAL

(75) Inventors: Tadahisa Sakaguchi, Shizuoka (JP); Masanori Onuma, Shizuoka (JP); Nobuyuki Asakura, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/712,423

(22) Filed: Mar. 1, 2007

(65) Prior Publication Data

US 2007/0249225 A1 Oct. 25, 2007

(30) Foreign Application Priority Data

Apr. 25, 2006 (JP) ..... 2006-121056

(51) Int. Cl.
*H01R 9/05* (2006.01)

(52) U.S. Cl. ..... 439/585

(58) Field of Classification Search ..... 439/585, 439/610, 99
See application file for complete search history.

(56) References Cited

U.S. PATENT DOCUMENTS

| | | | | |
|---|---|---|---|---|
| 2,941,028 | A * | 6/1960 | Edlen et al. | 174/75 C |
| 3,566,007 | A * | 2/1971 | O'Keefe et al. | 174/88 C |
| 3,663,901 | A * | 5/1972 | Forney, Jr. | 333/260 |
| 3,699,504 | A * | 10/1972 | Huber | 439/585 |
| 5,561,900 | A * | 10/1996 | Hosler, Sr. | 29/828 |
| 6,770,817 | B2 * | 8/2004 | Kuwayama et al. | 174/84 C |
| 6,808,417 | B2 * | 10/2004 | Yoshida | 439/585 |

* cited by examiner

*Primary Examiner*—Javaid Nasri
(74) *Attorney, Agent, or Firm*—Kratz, Quintos & Hanson, LLP

(57) ABSTRACT

A coaxial cable with a terminal is formed by attaching the terminal to an end of the coaxial cable. A braided conductor at the end of the coaxial cable 1 is folded and covers the insulating sheath. A sleeve covers the braided conductor covering the insulating sheath. All around the sleeve is pressed equally. The terminal is attached to the sleeve.

5 Claims, 4 Drawing Sheets

METHOD OF ATTACHING TERMINAL AND COAXIAL CABLE WITH TERMINAL

CROSS REFERENCE TO RELATED APPLICATIONS

This application is on the basis of Japanese Patent Application No. 2006-121056, the contents of which are hereby incorporated by reference.

BACKGROUND OF THE INVENTION

1. Field of the Invention

The present invention relates to a method of attaching a terminal to an outer conductor of a coaxial cable, and to a coaxial cable having an outer conductor to which a terminal is attached.

2. Description of the Related Art

Various electronic components such as a head light, a rear light, a starter motor and the like are generally mounted on a vehicle.

For supplying electric power to the various electronic components, a wiring harness is arranged in a vehicle. A well-known coaxial cable may be used for the wiring harness. A terminal to be connected to such as the ground may be attached to a braided conductor of the coaxial cable as an outer conductor. The terminal includes a crimping piece for crimping the braided conductor to be attached to the braided conductor.

However, in such a way to attach the terminal to the braided conductor, for surely electrically connecting the terminal to the braided conductor, a large force is added to the crimping piece to crimp the braided conductor with the crimping piece. Therefore, a crimped part of the coaxial cable is deformed to be flattened. Characteristic impedance of the flattened crimped part is lower than the other part of the coaxial cable.

Of course, it is not desirable that the characteristic impedance of the coaxial cable is partially reduced, because a transmission loss of a high frequency signal, in particular over 100 MHz, is increased.

On the other hand, when the crimping force is reduced, the braided conductor is not surely contacted with the terminal.

Accordingly, an object of the present invention is to provide a method of attaching a terminal and a coaxial cable with a terminal which allows a secure contact between the braided conductor (outer conductor) and the terminal, and prevents the reduction of the local characteristic impedance.

SUMMERY OF THE INVENTION

In order to attain the object, according to the present invention, there is provided a method of attaching a terminal to an outer conductor of a coaxial cable including the steps of:

inserting the exposed outer conductor of the coaxial cable into a conductive tubular sleeve;

attaching firmly the outer conductor to the sleeve by pressing all around the sleeve with a uniform power; and attaching the terminal to the sleeve.

Preferably, the inserting step includes the steps of:

exposing the outer conductor from an end of the coaxial cable; and covering an outer skin of coaxial cable with the exposed outer conductor; and inserting the outer conductor into the sleeve.

According to another aspect of the present invention, there is provided a coaxial cable having an outer conductor to which a terminal is attached, wherein the outer conductor is inserted into a conductive tubular sleeve and attached firmly to the sleeve by pressing all around the sleeve with a uniform power, and the terminal is attached to the sleeve.

Preferably, the outer conductor is exposed from an end of the coaxial cable, an outer skin of coaxial cable is covered with the exposed outer conductor, and the outer conductor is inserted into the sleeve.

Preferably, the terminal includes a crimping piece for crimping the sleeve.

According to the method of attaching a terminal, even when the sleeve is attached firmly to the outer conductor, the sleeve of the coaxial cable is prevented from being deformed to be flattened.

Namely, the object of the present invention is to keep the section of the coaxial cable 1 (shown in FIG. 6) having the terminal circular for preventing a partial reduction of the characteristic impedance of the coaxial cable 1.

The characteristic impedance Z of the coaxial cable 1 can be generally expressed by a following equation (1) where L is an inductance of the coaxial cable 1, and C is a capacitance of the coaxial cable 1.

$$Z=(L/C)^{1/2} \tag{1}$$

An inductance L of the coaxial cable 1 can be generally expressed by a following equation (2), where μ is a magnetic permeability, d1 is an outer diameter of a center conductor 4 of the coaxial cable 1, d2 is a minimum outer diameter of the inner coat 5 of the coaxial cable 1.

$$L=(\mu/2\pi)*\ln(d2/d1) \tag{2}$$

Here, when the coaxial cable 1 is deformed to be flattened so that a cross sectional area of the center conductor 4 is constant and a cross sectional area of the inner coat 5 is constant, the minimum outer diameter d2 of the inner coat 5 is gradually changed. Thus, as shown in FIG. 7, the capacitance C and the inductance L of the coaxial cable 1 are changed.

Incidentally, a horizontal axis in FIG. 7 indicates a reduction rate of the diameter d2 when a perfect circle of the coaxial cable is 0%. Namely, as a curve goes to the right side in FIG. 7, the coaxial cable 1 becomes more flattened. Further, a solid line in FIG. 7 indicates the capacitance C, and an alternate long and short dash line in FIG. 7 indicates the inductance L. As the curve goes up, the value of the capacitance C or the inductance L is increased.

As shown in FIG. 7, when the coaxial cable 1 becomes more flattened, the capacitance C of the coaxial cable 1 is increased, and the inductance L of the coaxial cable 1 is decreased. Therefore, when the cable 1 becomes flattened, the characteristic impedance Z is reduced. Accordingly, when attaching the terminal to the coaxial cable 1, keeping the section of the coaxial cable 1 circular prevents the characteristic impedance Z of the coaxial cable 1 from being partially reduced.

These and other objects, features, and advantages of the present invention will become more apparent upon reading of the following detailed description along with the accompanied drawings.

DETAILED DESCRIPTION OF THE PREFERRED EMBODIMENTS

A method of attaching a terminal and a coaxial cable with a terminal according to an embodiment of the present invention will be explained with reference to FIGS. 1 to 5. The method according to this embodiment is a method to assemble a coaxial cable 3 with a terminal by attaching a terminal 2 to an end of the coaxial cable 1.

Figure 1:
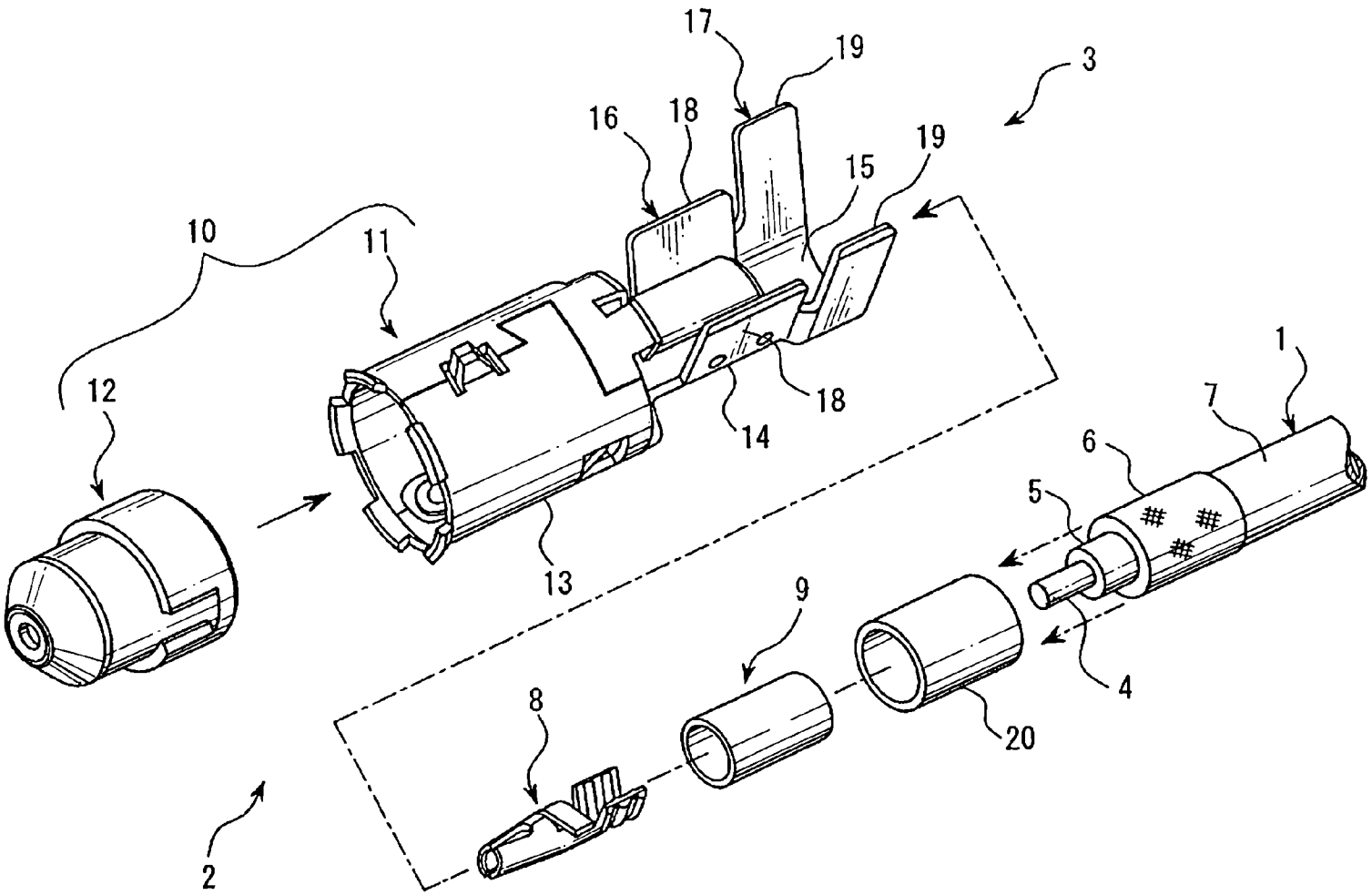
FIG. 1 is an exploded perspective view showing a coaxial cable with a terminal according to an embodiment of the present invention.

As shown in FIG. 1, the coaxial cable 1 includes a center conductor 4, an inner coating 5 coating the center conductor 4, a braided conductor 6 covering the inner coating 5 as an outer conductor, and a insulating sheath 7 covering the braided conductor 6 as an outer skin.

The center conductor 4 is made of metal, and formed in a line shape having a circular cross section. The circular conductor 4 is made of a one or a plurality of wires. The inner coating 5 is made of insulating synthetic resin. The braided conductor 6 is formed in a mesh shape by wires. The insulating sheath 7 is made of insulating synthetic resin. At an end of the coaxial cable 1, the insulating sheath 7 and the inner coating 5 are partially removed so that the center conductor 4, the inner sheath 5, and the braided conductor 6 are exposed. The insulating sheath is covered by the folded braided conductor 6 at the end of the coaxial cable 1.

As shown in FIG. 1, the terminal 2 includes a metallic inner terminal 8, an insulating tube 9 and a metallic shield terminal 10.

The inner terminal 8 is formed by folding a plate metal. The inner terminal 8 is crimped to the center conductor 4 to be attached to the coaxial cable 1. The inner terminal 8 is connected to various electronic components to supply electricity to them.

The insulating tube 9 is made of insulating and heat-shrinkable synthetic resin, and formed in a cylinder shape. The insulating tube 9 receives the inner terminal 8 and is shrunken by heating to be attached firmly to the inner terminal 8. The insulating tube 9 electrically isolates the inner terminal 8 from the shield terminal 10.

The shield terminal 10 is formed by folding a plate metal. The shield terminal 10 includes a main body 11 and a top end cap 12. The main body 11 includes a cap fixing part 13 and a wire connecting part 14.

The cap fixing part 13 is connected to the insulating tube 9 by fitting on an outer periphery of the insulating tube 9. The wire connecting part 14 includes a bottom wall 15 continued to the cap fixing part 13, a sleeve crimping part 16, and a sheath crimping part 17. A planar shape of the bottom wall 15 is formed in a rectangular shape, and an end of the bottom wall 15 is continued to the cap fixing part 13.

The sleeve crimping part 16 includes a pair of sleeve crimping pieces 18 extending vertically from outer edges of the bottom wall 15. The pair of sleeve crimping pieces 18 is extended from outer edges of the bottom wall 15 in a width direction thereof. A later described sleeve 20 attached to an end of the coaxial cable 1 is overlapped with the bottom wall 15, then the sleeve crimping part 16 is bent in a direction that the sleeve crimping pieces 18 approach the bottom wall 15. In the sleeve crimping part 16, the sleeve 20 attached to the end of the coaxial cable 1 is caught between the sleeve crimping pieces 18 and the bottom wall 15, and crimped to be electrically connected to the braided conductor 6 attached to the end of the coaxial cable 1. The sleeve crimping pieces 18 is a crimping piece in claims.

The sheath crimping part 17 includes a pair of sheath crimping pieces 19. The sheath crimping pieces 19 are extended from outer edges of the bottom wall 15 in a width direction thereof, and positioned further from the cap fixing part 13 than the sleeve crimping pieces 18.

The x is bent in a direction that the sheath crimping pieces 19 approach the bottom wall 15. In the sheath crimping part 17, the insulating sheath 7 of the coaxial cable 1 overlapped with the bottom wall 15 is caught between the sheath crimping pieces 19 and the bottom wall 15 and crimped.

A top end cap 12 is made of a plate metal and formed in a cylinder shape of which one end is closed. The top end cap 12 is attached to the cap fixing part 13 of the main body 11.

In the shield terminal 10, the cap fixing part 13 is attached to an outer periphery of the insulating tube 9, the sleeve crimping part 16 is crimped with the sleeve 20, and the sheath crimping part 17 is crimped with the insulating sheath 7, so that the shield terminal 10 is fixed to both the coaxial cable 1 and the insulating tube 9. Thus, the shield terminal 10 is electrically connected to the braided conductor 6 of the coaxial cable 1 via the sleeve 20. Resultingly, the shield terminal 10 is electrically connected to such as an earth of the electronic components.

The insulating tube 9 is fitted into an outer periphery of the inner terminal 8 attached to the center conductor 4 of the coaxial cable 1. The cap fixing part 13 of the main body 11 of the shield terminal 10 is fitted into the outer periphery of the insulating tube 9. The top end cap 12 is attached to the cap fixing part 13 of the main body 11. Thus, the terminal 2 is assembled. Then, in the terminal 2, the coaxial cable 1 and the sleeve 20 attached to the coaxial cable 1 are overlapped with the bottom wall 15, and the sleeve crimping pieces 18 and sheath crimping pieces 19 are bent toward the bottom wall 15 to crimp the sleeve 20 and the insulating sheath 7. Thus, the terminal 2 is attached to the end of the coaxial cable 1 and connected to the electronic components.

Figure 3:
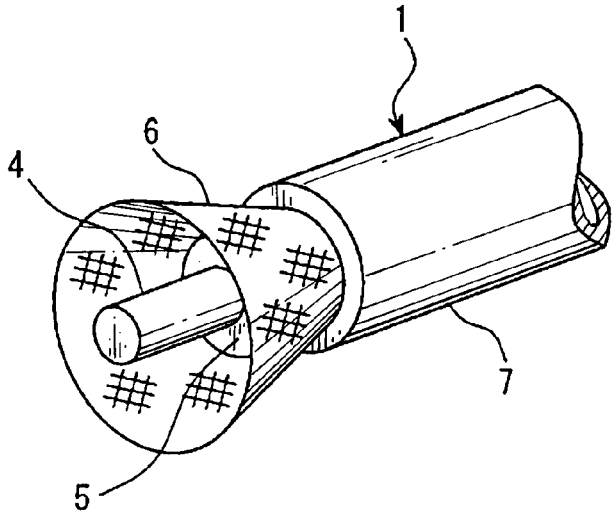
FIG. 3 is a perspective view showing the coaxial cable shown in FIG. 1 in a state eliminating an outer skin and an inner coating of an end thereof.
Figure 4:
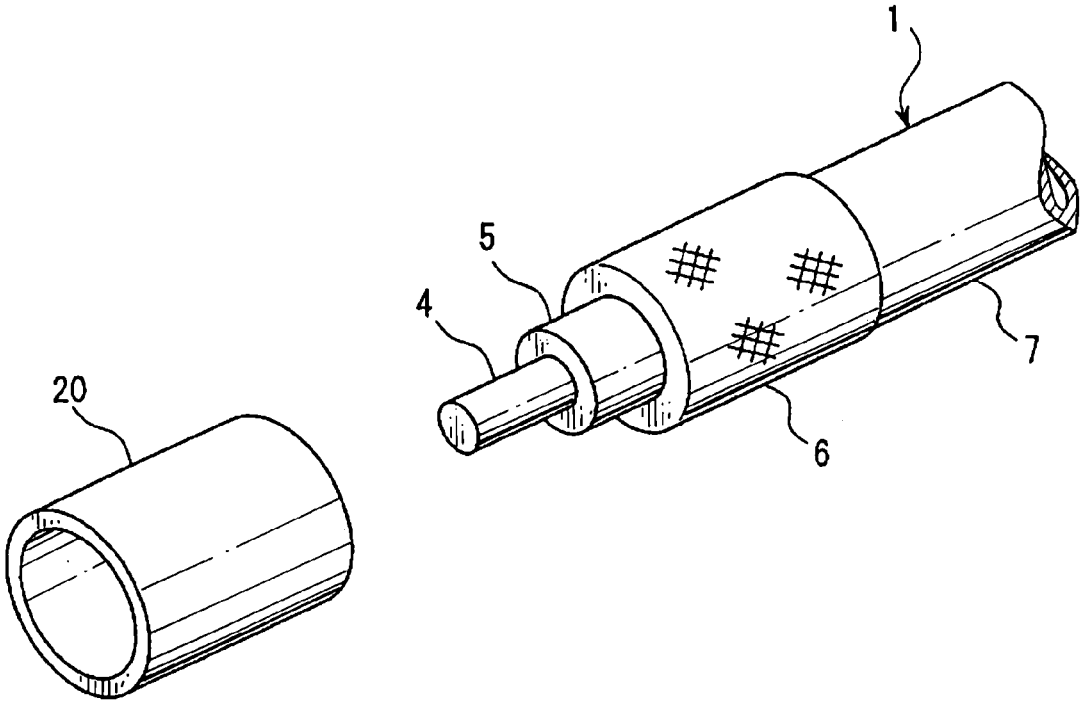
FIG. 4 is a perspective view showing a braided conductor of the coaxial cable shown in FIG. 3 covering an insulating sheath.
Figure 5:
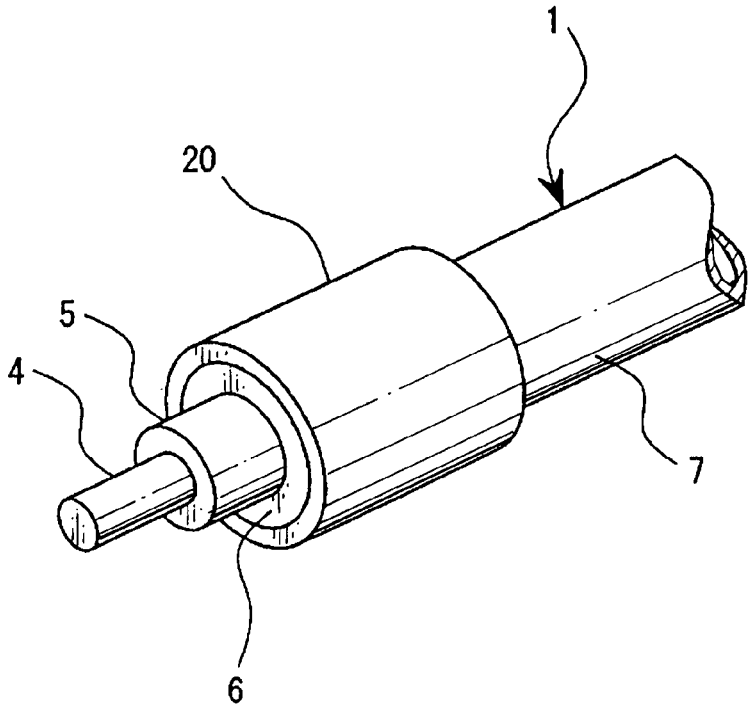
FIG. 5 is a perspective view showing the sleeve covering the braided conductor of the coaxial cable shown in FIG. 4.

The terminal 2 is attached to the end of the coaxial cable 1 as described below. First, the inner coating 5 and the insulating sheath 7 at the end of the coaxial cable 1 are partially removed and as shown in FIG. 3, the center conductor 4 and the braided conductor 6 are exposed. Then, the exposed braided conductor 6 is folded to cover the insulating sheath 7 as shown in FIG. 4. Then, the end of the coaxial cable 1 is inserted into the metallic tubular sleeve 20, so that the sleeve 20 covers the braided conductor 6 on the insulating sheath 7 as shown in FIG. 5. Incidentally, an inner diameter of the sleeve 20 is a little larger than an outer diameter of the braided conductor 6 covering the insulating sheath 7.

Figure 2:
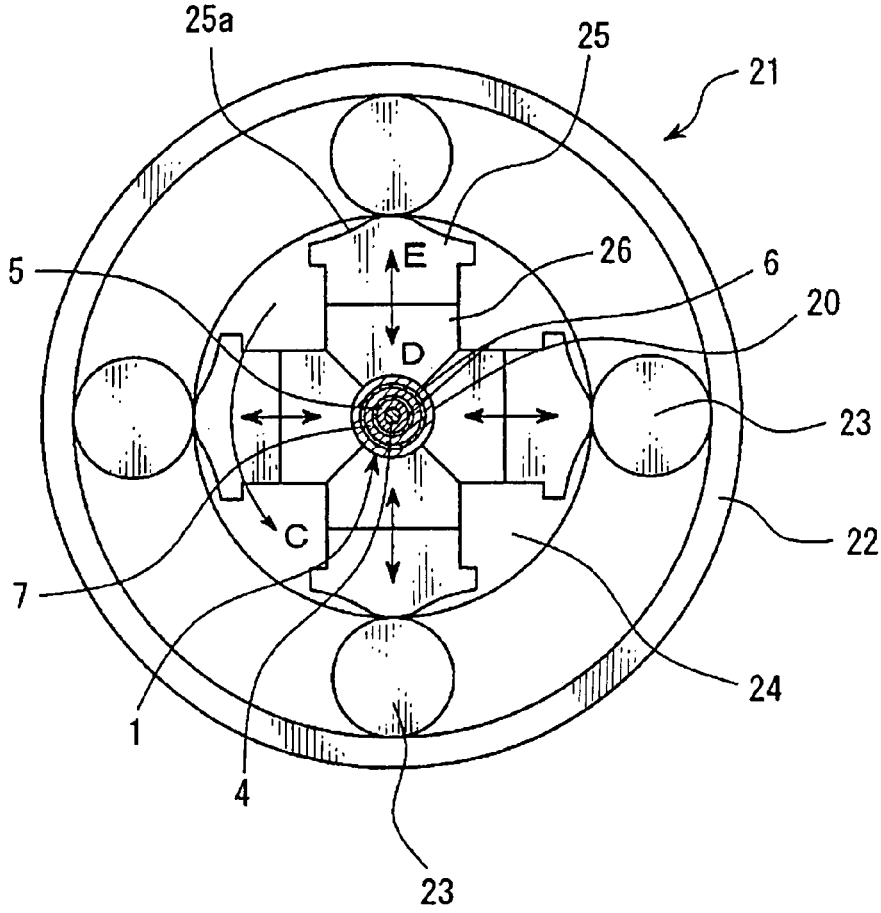
FIG. 2 is an explanatory view showing a rotary swaging machine for crimping a sleeve of the coaxial cable shown in FIG. 1.

Then, with a rotary swaging machine 21 as shown in FIG. 2, the sleeve 20 is pressed equally all around the periphery thereof in a direction to decrease the diameter of the sleeve 20. As shown in FIG. 2, the rotary swaging machine 21 includes a ring 22, a plurality of rollers 23, a spindle 24, a hammer 25, and a die 26.

The ring 22 is formed in a ring shape. The roller 23 is formed in a column shape and rotatably mounted on an inner circumference of the ring 22. The spindle 24 is disposed in the ring 22 coaxially with the ring 22. A not-shown motor rotates the spindle 24.

The hammer 25 and the die 26 are disposed side by side along a radial direction of the ring 22. The die 26 is disposed inner than the hammer 25 in the ring 22. Four dies 26 and four hammers 25 are disposed in a same interval in a circumferential direction of the ring 22. Namely, four of dies 26 and the hammers 25 are disposed at 90 degrees relative to each other. The sleeve 20 is interposed between the dies 26. The sleeve 20 is efficiently knocked by the four dies 26 bit by bit to be crimped. Thus, the sleeve 20 is crimped uniformly.

The not-shown motor rotates the spindle 24 of the rotary swaging machine 21. Thus, the die 26 and the hammer 25 are rotated together in a direction of an arrow C. When a top of a cam face 25*a* of the hammer 25 touches the roller 23, the dies 26 are closed inward in a direction of an arrow D to knock the sleeve 20 in a radial direction. As a slope of the cam face 25*a* touches the roller 23, the dies 26 are opened outward in a direction of arrow E by a centrifugal force. In the rotary swaging machine 21, this action is repeated in a small pitch to press all around the sleeve 20 equally.

Thus, all around the sleeve 20 is equally pressed, so that the sleeve 20 and the braided conductor 6 are closely attached to each other, and the sleeve 20 is attached to the end of the coaxial cable 1. Then, the inner terminal 8 is attached to the center conductor 4, the insulating tube 9 covers the outer periphery of the inner terminal 8, and the insulating tube 9 is heated. Then, the inner terminal 8 and the insulating tube 9 are closely attached to each other.

Then, the cap fixing part 13 of the main body 11 is fitted into the outer periphery of the insulating tube 9. The top end cap 12 is attached to the cap fixing part 13 of the main body 11. Thus, the terminal 2 is assembled. Then, the coaxial cable 1 and the sleeve 20 attached to the coaxial cable 1 are overlapped with the bottom wall 15. The sleeve crimping pieces 18 and the sheath crimping pieces 19 are bent toward the bottom wall 15 to crimp the sleeve 20 and the insulating sheath 7. Thus, the terminal 2 is attached to the end of the coaxial cable 1 to attain the coaxial cable 3 with the terminal.

According to the present embodiment, because the sleeve 20 having the braided conductor 6 inside thereof is pressed all around equally so that the braided conductor 6 and the sleeve 20 are closely attached to each other, even when the sleeve 20 and the braided conductor 6 are closely attached to each other, the sleeve 20, namely, the terminal 2 is prevented from being deformed to be flattened.

Thus, the coaxial cable having the sleeve 20 is kept circular, the characteristic impedance of the coaxial cable 1 having the sleeve 20 is prevented from being reduced. Therefore, a passing characteristic of a high frequency signal, in particular over 100 MHz, is prevented from being worse.

The braided conductor 6 covering the insulating sheath 7 is inserted into the sleeve 20, and the terminal 2 is attached to the sleeve 20, the braided conductor 6 inserted into the sleeve 20 is supported by the insulating sheath 7, the braided conductor 6, the center conductor 4, the and the inner coating 5. Therefore, rigidity of the braided conductor 6 inserted into the sleeve 20 is increased. Therefore, the coaxial cable 1 having the sleeve 20 is surely kept circular.

Because the terminal 2 includes the sleeve crimping pieces 18 for crimping the sleeve 20, the terminal 2 can be attached to the sleeve 20 with an easy process. Therefore, the terminal 2 can be attached to the braided conductor 6 of the coaxial cable 1 with an easy process.

Figure 6:
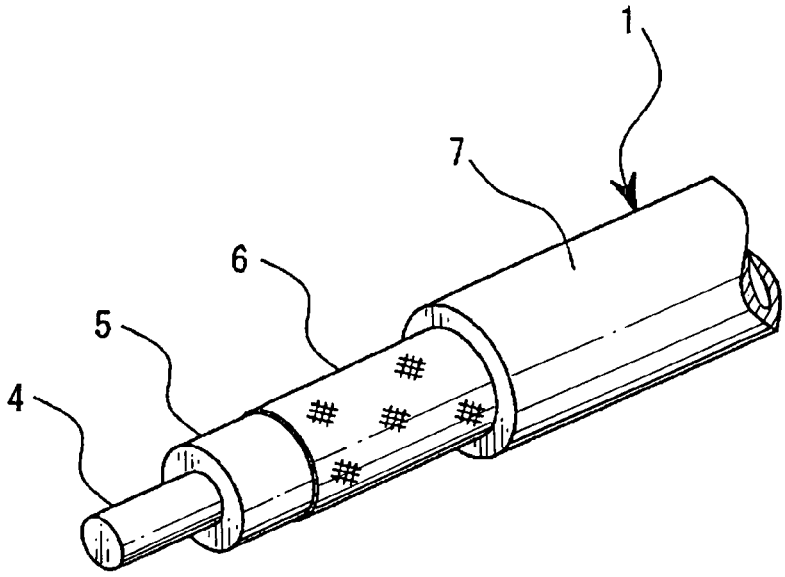
FIG. 6 is a perspective view showing another example of the coaxial cable shown in FIG. 4.
Figure 7:
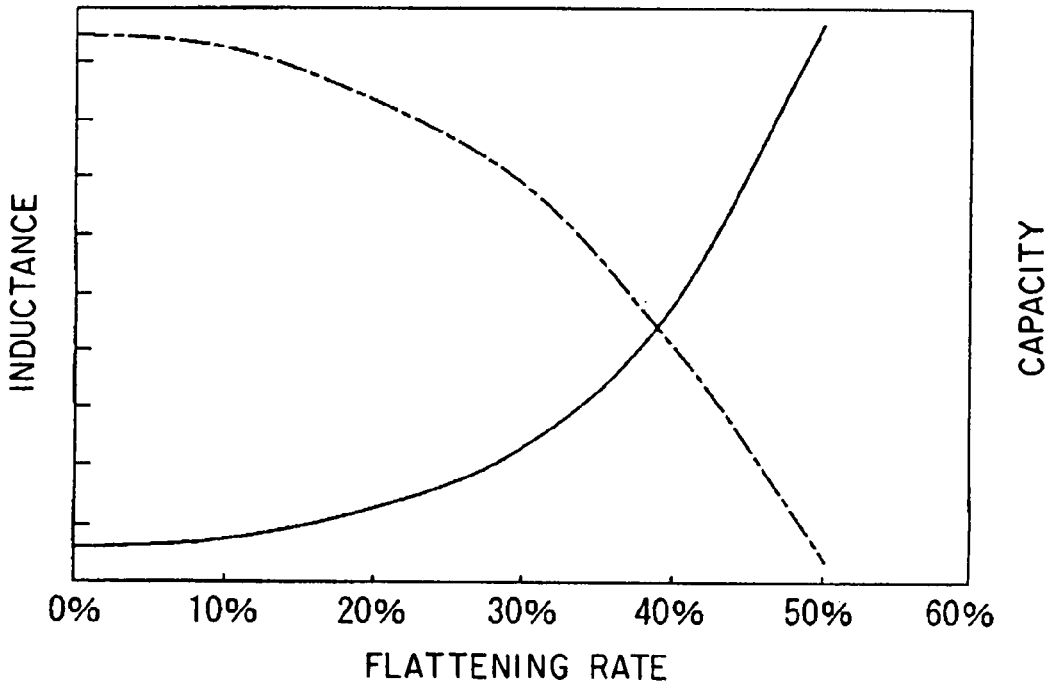
FIG. 7 is an explanatory view showing a flattening rate of the coaxial cable and changes of a capacitance and an inductance.

In the embodiment described above, the terminal 2 includes the inner terminal 8 for connecting to the center conductor 4. However, according to the present invention, the terminal 2 may not have the inner terminal 8 and only have the sleeve crimping pieces 18 for crimping the sleeve 20. In the embodiment described above, the braided conductor 6 covers the insulating sheath 7. However, according to the present invention, as shown in FIG. 6, the braided conductor 6 may not cover the insulating sheath 7. Further, according to the present invention, the sleeve may be pressed all around equally by not only the rotary swaging machine 21 shown in FIG. 2, but by a general crimping machine having an anvil and a crimper.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A method of attaching a terminal to an outer conductor of a circular coaxial cable comprising the steps of:

inserting the outer conductor of the circular coaxial cable, having a braided conductor, into a conductive tubular sleeve;

attaching firmly the outer conductor to the sleeve by pressing equally all around the periphery of the sleeve, in a direction to equally decrease the diameter of the sleeve with a uniform power, by four dies, disposed at 90 degrees relative to each other, which are closed inward and rotate about the sleeve, such that the diameter of the sleeve is reduced and the braided conductor and sleeve attached, while the coaxial cable is kept circular; to prevent the characteristic impedance of the coaxial cable from partially reducing; and then attaching the terminal to the sleeve.

2. The method as claimed in claim 1, wherein said inserting step includes the steps of:

exposing the outer conductor from an end of the coaxial cable; and covering an insulating sheath of the coaxial cable with the exposed outer conductor; before inserting the outer conductor into the sleeve.

3. A circular coaxial cable having a braided conductor and an outer conductor to which a terminal is attached, wherein the outer conductor is inserted into a conductive tubular sleeve and attached firmly to the sleeve by pressing equally all around the periphery of the sleeve in a direction to equally decrease the diameter of the sleeve with a uniform power, by four dies, disposed at 90 degrees relative to each other, which are closed inward and rotate about the sleeve, such that the diameter of the sleeve is reduced and the braided conductor and sleeve attached, while the coaxial cable is kept circular, to prevent the characteristic impedance of the coaxial cable from partially reducing, and the terminal is then attached to the sleeve.

4. The circular coaxial cable as claimed in claim 3, wherein the outer conductor is exposed from an end of the coaxial cable, and an insulating sheath of the coaxial cable is covered with the exposed outer conductor, before the outer conductor is inserted into the sleeve.

5. The circular coaxial cable as claimed in claim 3, wherein the terminal includes a crimping piece for crimping the sleeve.

* * * * *